US006764578B2

(12) United States Patent
Gustavsson

(10) Patent No.: US 6,764,578 B2
(45) Date of Patent: Jul. 20, 2004

(54) SUSPENSION ARRANGEMENT FOR A ROLL

(75) Inventor: Tord Gustavsson, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 25 days.

(21) Appl. No.: 09/962,278

(22) Filed: Sep. 24, 2001

(65) Prior Publication Data

US 2002/0117284 A1 Aug. 29, 2002

Related U.S. Application Data

(63) Continuation of application No. PCT/SE00/00183, filed on Jan. 31, 2000.

(30) Foreign Application Priority Data

Mar. 25, 1999 (SE) ..... 9901092

(51) Int. Cl.[7] ..... D21F 3/08; D21G 1/00

(52) U.S. Cl. ..... 162/358.1; 162/272; 162/273; 162/274; 100/168; 100/170; 100/171

(58) Field of Search ..... 162/358.1, 272, 162/273, 274; 100/168, 170, 171

(56) References Cited

U.S. PATENT DOCUMENTS 286,587 A * 10/1883 Case ..... 162/358.1
3,547,776 A * 12/1970 Curtis ..... 162/358.1
3,611,917 A 10/1971 Bryce et al.
3,978,784 A * 9/1976 Bryce et al. ..... 100/170
4,464,986 A * 8/1984 Bollani ..... 162/358.1
4,842,209 A 6/1989 Saukkonen
4,915,026 A * 4/1990 Halme ..... 162/272
5,022,319 A * 6/1991 Biondetti ..... 100/170

FOREIGN PATENT DOCUMENTS

GB 1 528 962 10/1978

* cited by examiner

*Primary Examiner*—Peter Chin
*Assistant Examiner*—Mark Halpern
(74) *Attorney, Agent, or Firm*—Alston & Bird LLP

(57) ABSTRACT

A vibration-minimizing suspension mechanism for a press roll is provided. The press roll and an opposing roll each having a rotational axis and cooperate to form a press nip adapted to impart a linear load on a fiber web passing therethrough. The linear load is oriented through the rotational axes of the press roll and the opposing roll. As such, the suspension mechanism comprises a suspension arm having opposed ends and a medially-disposed pivot, wherein the press roll is rotatably engaged at the rotational axis thereof with one of the opposed ends of the suspension arm. The suspension arm is further pivotably and adjustably mounted at the pivot so as to allow the pivot to be adjusted in substantially parallel relation to the linear load. The adjustability of the pivot thereby allowing a mounting line along the suspension arm, the mounting line being defined by the pivot and the rotational axis of the press roll, to be maintained in substantially perpendicular orientation to the linear load to thereby minimize vibration in the press roll.

22 Claims, 2 Drawing Sheets

SUSPENSION ARRANGEMENT FOR A ROLL

CROSS-REFERENCE TO RELATED APPLICATIONS

This application is a continuation of International Patent Application No. PCT/SE 00/00183, filed Jan. 31, 2000, which is incorporated herein by reference in its entirety.

FIELD OF THE INVENTION

The present invention relates to paper making machines and, more particularly, to a vibration-minimizing suspension mechanism for a press roll component of a press nip configured to apply a pressure treatment to a fiber web in a wet section and/or a calender of a paper making machine.

BACKGROUND OF THE INVENTION

In the pressure treatment of web-shaped materials, e.g. paper or cardboard, there is often used a rotatable roll which bears against another rotatable roll, whereby a pressure is created in the nip between the two rolls. The pressure nip is used, for example, for dewatering a web material, smoothing a web material, or for pressing two or more layers of a composite web material together. Examples of such arrangements of rolls are calender rolls and roll presses.

A roll conventionally comprises an annular roll shell which rotates about a central axis. The roll is normally suspended on a shaft, the shaft extending out of the roll at both ends thereof and being mounted in bearings on a suspension arm at each end. Such a suspension arm may comprise a straight-armed lever, wherein the roll shaft is mounted in bearings at a first location on said suspension arm, about a first end of the arm. The suspension arm itself may be mounted in bearings on a support structure at a second, intermediate location of the arm. Finally, a balancing force may be applied to the suspension arm at a third location thereof, about a second end of the arm. Typically, the suspension arm is suspended in the support at said second location, between said first and third location, somewhere along the arm. The purpose of the balancing force which is applied at the third location is to press the roll against an adjacent roll, in order to form a pressure nip. The size of the balancing force which is needed is typically calculated from the length of the two lever arms, the weight of the roll, and the linear load in the nip.

However, a standard design, such as the above, often exhibits problems due to vibrations in the roll during operation, which can lead to quality deficiencies of the web being produced or even premature wear or break down of the machine. The vibrations are produced for a variety of reasons, e.g. speed variations of the driving roll or the gear box, a non-round surface of the roll, varying hardness/thickness of the coating of a rubber coated roll, varying liquid content of a press felt passing through the nip, varying thickness of the paper web, etc. This implies that the theoretical force balancing system which is used to determine the configuration of the nip is not a true representation of the actual forces in the system.

There have been many suggestions as to how the vibration problems in connection with the operation of such rolls could be solved. Most of the suggestions relate to different devices which are directed to damping the vibrations. Such devices are for example shown in U.S. Pat. No. 3,512,475; U.S. Pat. No. 5,730,692; U.S. Pat. No. 4,910,842; U.S. Pat. No. 5,081,759; DE 196 52 769 and EP-B1-0 268 769.

DE 42 32 920 discloses a method directed to avoiding the formation of vibrations, rather than damping the vibrations.

However, this method does not primarily relate to eliminating vibrations in relation to rolls for producing a paper web, wherein such paper webs are extremely thin, e.g. 0.1–3.0 mm. Moreover, this method does not focus on the suspension of the rolls.

SUMMARY OF THE INVENTION

One embodiment of the present invention provides a suspension arrangement for a roll in a paper making machine, wherein the suspension arrangement is arranged to avoid or at least minimize generation of vibrations during operation of the roll. More particularly, a suspension arrangement for a press roll is provided, the roll forming a pressure nip for a fiber web with at least one other roll and being rotatably mounted in bearings on a suspension arm at a first location on said suspension arm, said suspension arm being mounted on a support structure at a second location on the arm, wherein said suspension arm is configured such that a line passing through said first location and said second location of the suspension arm is substantially perpendicular to the direction of the linear load.

According to one aspect of the invention, the second location of the suspension arm is attached to said support structure in such a manner that the suspension arm is adjustable in a direction parallel to the direction of the linear load.

According to another aspect of the invention, the roll is used for pressure treatment of web-shaped materials, for example in the press section of a paper making machine or in a calender.

BRIEF DESCRIPTION OF THE DRAWINGS

The present invention will be further described with reference to the drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
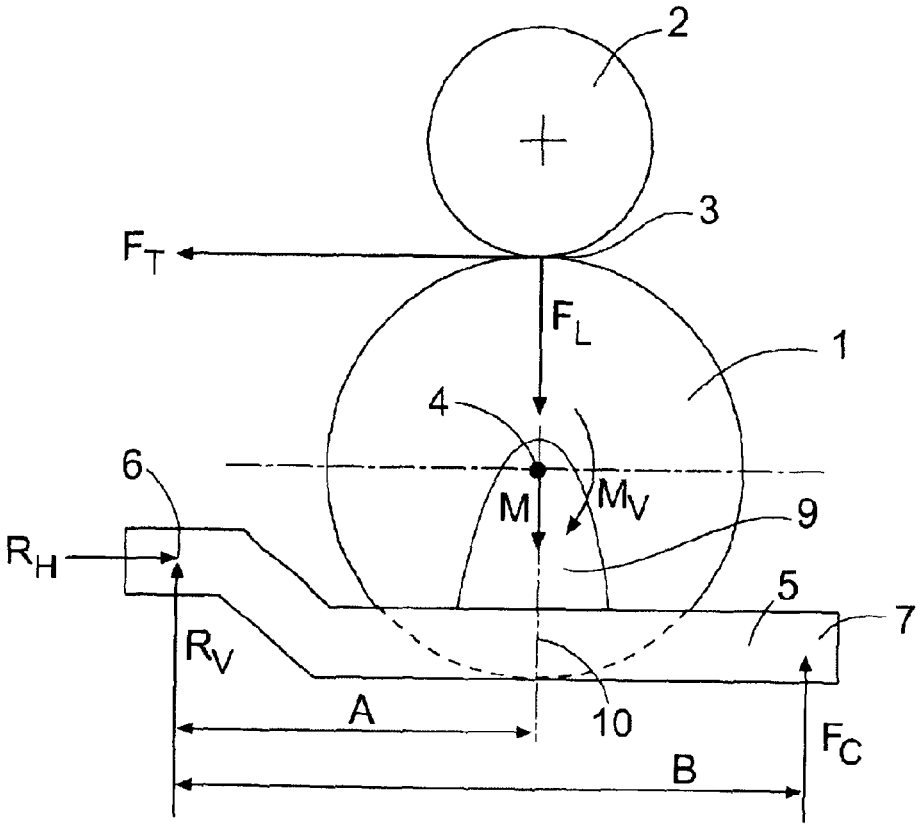
FIG. 1 (PRIOR ART)
FIG. 1 is a side view of a first roll suspended on a suspension arm according to a prior art configuration, the first roll and a second roll forming a nip at the contact surface between the two rolls.
Figure 2:
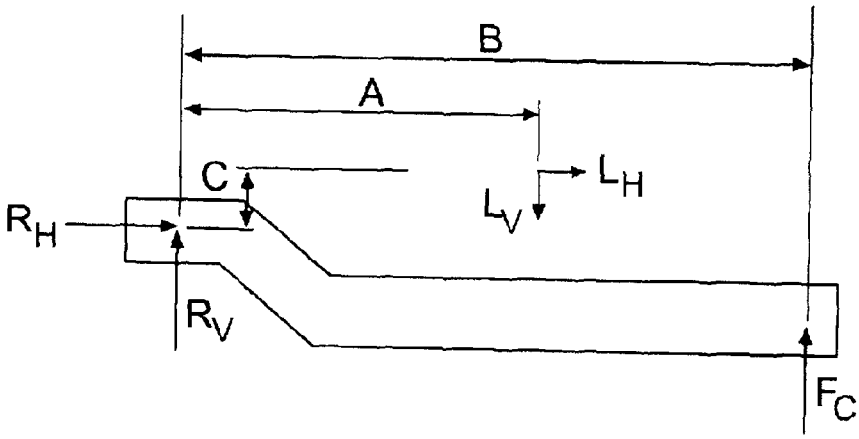
FIG. 2 (PRIOR ART)
FIG. 2 is a diagram showing the forces acting on a prior art suspension arm.
Figure 3:
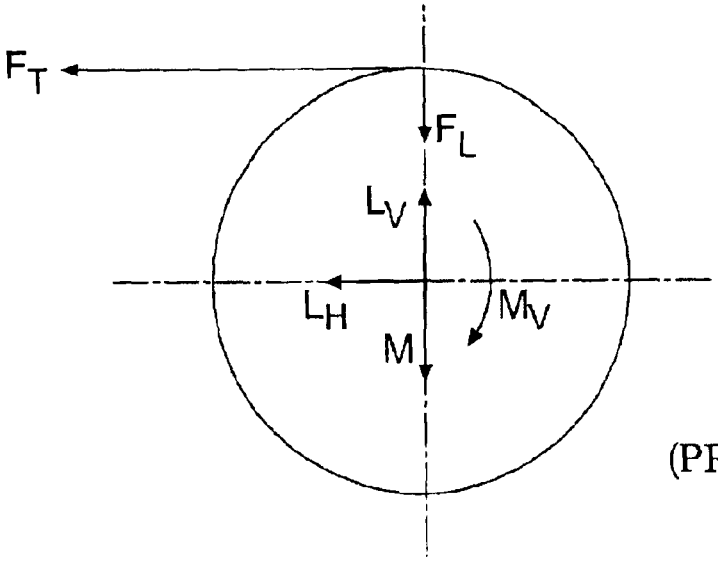
FIG. 3 (PRIOR ART)
FIG. 3 is a diagram showing the forces acting on the press roll mounted on a prior art suspension arm.

FIG. 1 shows a prior art first roll 1 such as, e.g. a calender roll, bearing against a second roll 2 to thereby form a pressure nip 3. The first roll 1 is mounted on bearings at a first location 4 within a support structure 9, which is intermediately mounted on a prior art suspension arm 5, which suspension arm 5 is of conventional design. The suspension arm 5 itself is mounted on bearings at a second location 6, e.g. an axis of rotation, which is positioned at a first end of the suspension arm 5. The suspension arm 5 may thus pivot about said second location 6 in a structure, e.g. framework (not shown), in which it is suspended. At a third location 7 on the suspension arm 5, a force $F_C$ is applied, such as by a hydraulic assembly (not shown), to counteract the force M due to the mass of the first roll 1 and the force $F_L$ due to the pressure in the pressure nip 3 where, e.g. $F_L$ is a counterforce created by the load applied by $F_C$, wherein the force $F_L$ is directed along a line 10 passing through the nip 3 and the first location 4. In such a prior art system, as shown, the second location 6 is arranged at a second end of the suspension arm 5. Conventionally, the system, such as shown in FIG. 1, is balanced by applying a force $F_C$, which is calculated according to a balancing of forces, where:

$$F_C \times B = A(F_L + M), \tag{a}$$

B is the length of the lever arm between the axis of rotation at the second location 6 of the suspension arm 5 and the third location, while A is the length of the lever arm between the axis of rotation at the second location 6 of the suspension arm 5 and the first location. Note that the roll 1 is normally rotatably mounted on two suspension arms, one at each end of the roll 1. As such, it will be appreciated that the illustrated forces shown acting on one suspension arm 5 are shown as such for analysis purposes, wherein the actual magnitude of the forces must be appropriately adjusted to account for the second suspension arm also supporting the roll 1.

When forces are balanced in the illustrated system, according to equation (a) above, problems with vibrations in the roll 1 are often experienced during operation, that is during the rotation of the roll 1. It has now surprisingly been found that by performing a more detailed equilibrium analysis or balancing of forces, and by designing the suspension arm 5 to avoid the influence of certain forces, the system can be balanced to avoid or minimize vibration and vibration-related problems.

Due to minor deficiencies such as, e.g. irregularities in the coating of the roll, irregularities in the balancing of the roll itself, or speed variations of the driving roll and/or the gear box, variations in the thickness of the web treated in the pressure nip 3 may result in a force $F_T$ in the nip 3, wherein the force $F_T$ is directed along a tangent to the first roll 1. The force $F_T$ has a lever arm which corresponds to half the diameter (e.g. the radius) of the first roll 1. Thus, taking the force $F_T$ into account, the balancing of forces becomes:

FIG. 3

$$\rightarrow -F_T - L_H = 0 \tag{1}$$

$$\uparrow L_V - M - F_L = 0 \tag{2}$$

$$\circlearrowright M_V - F_T \cdot r = 0 \tag{3}$$

FIG. 2

$$\rightarrow R_H + L_H = 0 \tag{4}$$

$$\uparrow R_V - L_V + F_C = 0 \tag{5}$$

$$\circlearrowright L_V \cdot A - F_C \cdot B + L_H \cdot C = 0 \tag{6}$$

Thus, equation (2) gives $$F_L = L_V - M$$

and equation (6) gives $$L_V = F_C \frac{B}{A} - L_H \frac{C}{A}$$

while equation (1) gives $$L_H = -F_T$$

$$\text{Thus,} \quad F_L = F_C \frac{B}{A} + F_T \frac{C}{A} - M \tag{7}$$

Definitions:

$F_L$ and $F_T$ are a linear load and a tangential force in the pressure nip, respectively.

$F_C$ is the applied force on the system, e.g. by a hydraulic cylinder or the like.

$R_H$ and $R_V$ are reaction forces in the pivot axle.

$L_H$ and $L_V$ are reaction forces in the bearing of the roll.

$M_V$ is the torsional moment.

M is the force of the weight of the roll.

A, B, and C are geometric distances.

It is now realised that if $F_C$ and M are constant and $F_T$ varies, then $F_L$ must also vary, the variances in $F_T$ and $F_L$ therefore resulting in vibrations. Such variances may be apparent where there are variations in the speed of the driving roll and/or the gear box, which transmits the rotational force to the roll, since only forces acting in a tangential direction $F_T$ will be affected. However, though the tangential force $F_T$ may vary due to irregularities, e.g. of the web, there will generally be an insignificant influence on $F_L$ due to inertial forces, e.g. $F_T$ will have the major influence with respect to being the cause of vibrations, since $F_C$ remains essentially constant.

Figure 4:
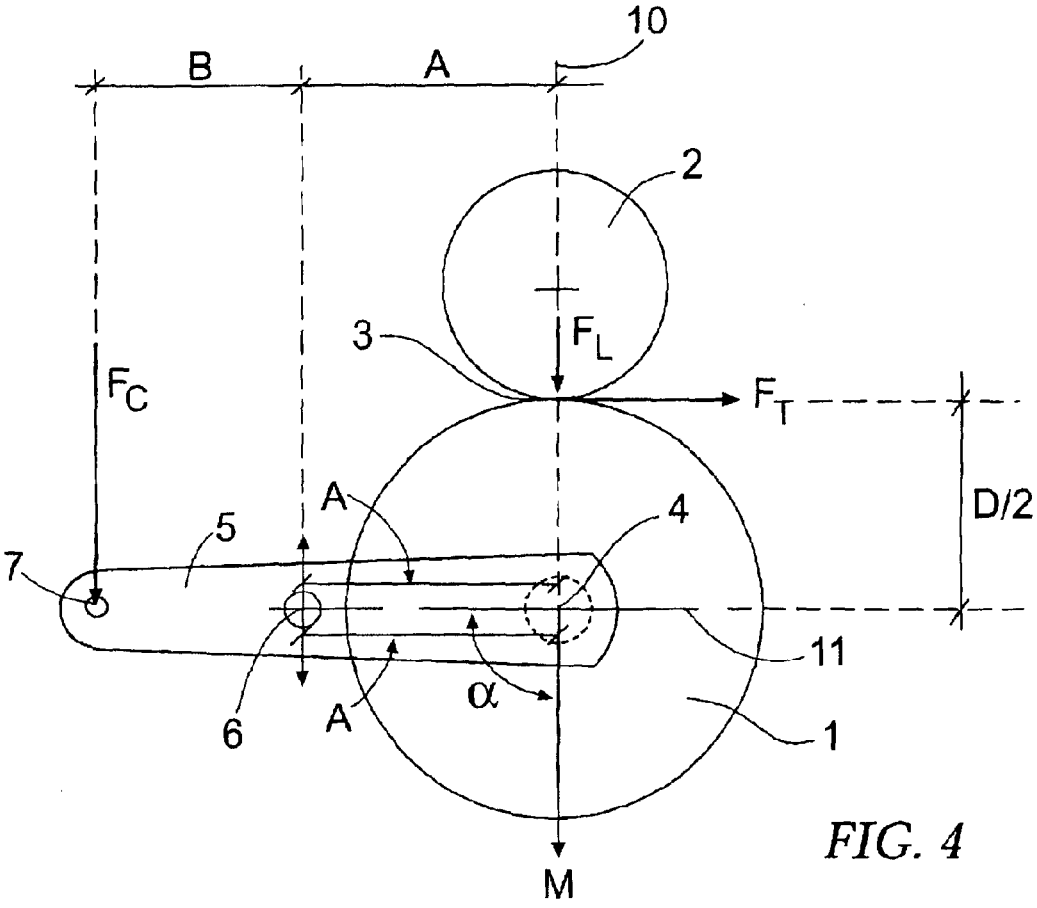
FIG. 4 is a side view of a first roll suspended on a suspension arm according to one embodiment of the present invention, the first roll and a second roll forming a nip at the contact surface between the two rolls.

According to the present invention, an embodiment of which is shown in FIG. 4, it is realized that the influence of the force $F_Y$ on $F_L$ can be minimized, or even eliminated in some instances, by choosing the second location 6 so as to make C=0. Accordingly, the suspension arm 5 in FIG. 4 is arranged such that a line 11 passing through the first location 4 and the second location 6 of the suspension arm 5 is perpendicular to the direction 10 of the linear load $F_L$. Accordingly, where C=0, the force $F_Y$ will have no effect, as shown in equation (7). Thus, the force $F_L$ of the pressure nip 3 will be constant when $F_C$ and M are constant, thereby avoiding or at least minimizing vibration. It will be further appreciated that advantages of the present invention may also be realized when the line 11 passing through the first location 4 and the second location 6 of the suspension arm 5 is substantially perpendicular to the direction 10 of the linear load $F_L$. More particularly, advantages of the present invention may also be realized in instances where, for example, the line 11 is disposed at an angle of between about eight-eight degrees and about ninety-two degrees with respect to the direction 10 of the linear load $F_L$.

Thus, the suspension arm 5 according to embodiments of the present invention is configured such that the second location 6, at which the arm 5 is mounted on bearings, is at the same level as the first location 4 such that C=0. Accordingly, as compared to the distance C as shown in FIG. 1, a value of C=0 eliminates the effect of the force $F_T$ according to equation (7).

Further, in the embodiment shown in FIG. 4, the third location 7, e.g. the location of the balancing force $F_C$, is positioned on the opposite side of the pivot point 6, which allows the suspension arm 5 to be straight, in contrast to the prior art suspension arm shown in FIG. 1.

It is not unusual that rolls, such as those described herein, are treated in some manner, e.g. re-coated, ground, etc., after operation for a certain period. Such treatments will typically alter the diameter of the roll. Accordingly, embodiments of the present invention advantageously comprise an adjustable attachment point 6, i.e. the second location 6, for the suspension arm 5. More particularly, the second location 6 is configured to be adjustable such that, after treatment of the roll 1, the second location 6 may be re-adjusted in order to obtain C=0. This described adjustability of the second location 6 may be achieved in many ways such as, e.g. by providing a slot in either the frame structure or the suspension arm 5 such that the axis of rotation 6 is movable within the slot. The axis of rotation 6 may then be fixed when the line 11 between the first location 4 and the second location 6 is perpendicular to the line 10 indicating the direction of the linear load $F_L$.

Typically, the design of the suspension arm 5 according to embodiments of the invention is applied to machine configurations having linear loads of between about 0.1 kN/m and about 500 kN/m and, more particularly, between about 80 kN/m and about 100 kN/m, wherein the roll 1 may have a diameter of between about 600 mm and about 2000 mm and, more particularly, between about 800 mm and about 1500 mm. Accordingly, the length of the lever arms A and B according to such embodiments of the invention are typically between about 1000 mm and about 2500 mm and between about 2000 mm and 5000 mm, respectively.

Many modifications and other embodiments of the invention will come to mind to one skilled in the art to which this invention pertains having the benefit of the teachings presented in the foregoing descriptions and the associated drawings. For instance, the suspension arm may be positioned in many different ways with respect to the support structure. Moreover, the pivot point 6 may be adjustable in directions other than parallel with respect to the linear load such as, e.g. following a curve or a non-parallel line. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A vibration-minimizing suspension mechanism for a press roll, the press roll forming a press nip with only an opposing roll, each of the rolls having a rotational axis, the press nip being adapted to impart a linear load on a fiber web passing therethrough, the linear load being oriented through the rotational axes of the press roll and the opposing roll, said suspension mechanism comprising:

a suspension arm having opposed ends and a medially-disposed pivot, the press roll being rotatably engaged at the rotational axis thereof with one of the opposed ends of the suspension arm, the other of the opposed ends of the suspension arm being configured to have a force applied thereon so as to provide the linear load at the press nip about the pivot, the suspension arm further being pivotably and adjustably mounted at the pivot so as to allow the pivot to be adjusted in substantially parallel relation to the linear load, the adjustability of the pivot thereby allowing a mounting line along the suspension arm, the mounting line being defined by the pivot and the rotational axis of the press roll, to be maintained in substantially perpendicular orientation to the linear load to thereby minimize vibration in the press roll.

2. A mechanism according to claim 1 wherein the mounting line is disposed at an angle of between about eighty-eight degrees and about ninety-two degrees with respect to the linear load.

3. A mechanism according to claim 1 wherein the mounting line is disposed at an angle of between about eighty-nine degrees and about ninety-one degrees with respect to the linear toad.

4. A mechanism according to claim 1 wherein the mounting line is disposed at an angle of about ninety degrees with respect to the linear load.

5. A mechanism according to claim 1 wherein the opposed ends and the pivot are disposed along the mounting line.

6. A mechanism according to claim 1 wherein the force is substantially constant.

7. A mechanism according to claim 1 wherein the linear load produces a linear load torque on the suspension arm about the pivot and the force is configured to produce an opposing torque on the suspension arm, the opposing torque being at least equal to the linear load torque.

8. A mechanism according to claim 1 wherein the linear load is between about 80 kN/m and about 500 kN/m.

9. A mechanism according to claim 1 wherein the linear load is between about 80 kN/m and about 100 kN/m.

10. A mechanism according to claim 1 wherein the press roll has a diameter of between about 600 mm and about 2000 mm.

11. A mechanism according to claim 1 wherein the press roll has a diameter of between about 800 mm and about 1500 mm.

12. A vibration-minimizing press nip for a paper making machine, said press nip comprising:

a press roll having a rotational axis;

an opposing roll having a rotational axis and cooperating with the press roll to form the press nip therebetween, the press nip being adapted to impart a linear load on a fiber web passing therethrough, the linear load being oriented through the rotational axes of the press roll and the opposing roll; and a suspension arm having opposed ends and a medially-disposed pivot, the press roll being rotatably engaged at the rotational axis thereof with one of the opposed ends of the suspension arm, the other of the opposed ends of the suspension arm being configured to have a force applied thereto so as to provide the linear load at the press nip about the pivot, the suspension arm further being pivotably and adjustably mounted at the pivot so as to allow the pivot to be adjusted in substantially parallel relation to the linear load, the adjustability of the pivot thereby allowing a mounting line along the suspension arm, the mounting line being defined by the pivot and the rotational axis of the press roll, to be maintained in substantially perpendicular orientation to the linear load to thereby minimize vibration in the press roll.

13. A mechanism according to claim 12 wherein the mounting line is disposed at an angle of between about eighty-eight degrees mid about ninety-two degrees with respect to the linear load.

14. A mechanism according to claim 12 wherein the mounting line is disposed at an angle of between about eighty-nine degrees and about ninety-one degrees with respect to the linear load.

15. A mechanism according to claim 12 wherein the mounting line is disposed at an angle of about ninety degrees with respect to the linear load.

16. A mechanism according to claim 12 wherein the opposed ends and the pivot are disposed along the mounting line.

17. A mechanism according to claim 13 wherein the force is substantially constant.

18. A mechanism according to claim 13 wherein the linear load produces a linear load torque on the suspension arm about the pivot and the force is configured to produce an opposing torque on the suspension arm, the opposing torque being at least equal to the linear load torque.

19. A mechanism according to claim 12 wherein the linear load is between about 0.1 kN/m and about 500 kN/m.

20. A mechanism according to claim 12 wherein the linear load is between about 80 kN/m and about 100 kN/m.

21. A mechanism according to claim 12 wherein the press roll has a diameter of between about 600 mm and about 2000 mm.

22. A mechanism according to claim 12 wherein the press roll has a diameter of between about 800 mm and about 1500 mm.

* * * * *

UNITED STATES PATENT AND TRADEMARK OFFICE

CERTIFICATE OF CORRECTION

PATENT NO. : 6,764,578 B2
DATED : July 20, 2004
INVENTOR(S) : Gustavsson

It is certified that error appears in the above-identified patent and that said Letters Patent is hereby corrected as shown below:

Column 6,
Line 14, “toad” should read -- load --;
Line 28, “80 kN/m” should read -- 0.1 kN/m --;
Line 40, after “cooperating” insert -- only --.

Column 7,
Lines 9 and 11, “claim 13” should read -- claim 12 --.

Signed and Sealed this

First Day of February, 2005

JON W. DUDAS
*Director of the United States Patent and Trademark Office*